US011332995B2

(12) United States Patent
Murphy

(10) Patent No.: US 11,332,995 B2
(45) Date of Patent: May 17, 2022

(54) COILED PISTON ASSEMBLY

(71) Applicant: FMC Technologies, Inc., Houston, TX (US)

(72) Inventor: Richard M. Murphy, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 16/606,679

(22) PCT Filed: Jun. 9, 2017

(86) PCT No.: PCT/US2017/036722
§ 371 (c)(1),
(2) Date: Oct. 18, 2019

(87) PCT Pub. No.: WO2018/226239
PCT Pub. Date: Dec. 13, 2018

(65) Prior Publication Data

US 2021/0396090 A1 Dec. 23, 2021

(51) Int. Cl.
*E21B 33/04* (2006.01)
*E21B 33/035* (2006.01)
*E21B 33/043* (2006.01)

(52) U.S. Cl.
CPC ..... *E21B 33/0415* (2013.01); *E21B 33/0355* (2013.01); *E21B 33/043* (2013.01)

(58) Field of Classification Search
CPC . E21B 33/0415; E21B 33/0355; E21B 33/043
See application file for complete search history.

(56) References Cited

U.S. PATENT DOCUMENTS 5,465,788 A 11/1995 Wright
6,179,053 B1 1/2001 Dallas
(Continued)

FOREIGN PATENT DOCUMENTS

EP 0 251 595 A2 1/1988
WO WO 2011/115601 A1 9/2011

OTHER PUBLICATIONS

European Patent Office, Extended European Search Report issued in connection with European Patent Application No. 17912601.6 (dated Jan. 29, 2021).

*Primary Examiner* — Giovanna Wright
*Assistant Examiner* — Yanick A Akaragwe
(74) *Attorney, Agent, or Firm* — Henry C. Query, Jr.

(57) ABSTRACT

A tubing hanger assembly includes a body having an annular outer surface, a lockdown feature which is located on the body, a load nut which is threadedly connected to the body and has a downward facing load shoulder, and a piston assembly for adjusting a vertical distance between the load shoulder and the lockdown feature. The piston assembly includes an elongated cylinder which is positioned circumferentially around the body axially adjacent the load nut. The cylinder has a first cylinder end which is connected to the body and an open second cylinder end. An elongated piston is slidably received in the cylinder. The piston has a first piston end which is oriented toward the first cylinder end and a second piston end which is configured to extend through the second cylinder end and engage the load nut such that extension of the piston causes the load nut to rotate relative to the body. A seal is positioned between the piston and the cylinder to thereby define a piston chamber between the first cylinder end and the first piston end which is connectable to a source of fluid pressure. In operation of the piston assembly, the piston rotates the load nut to thereby move the load
(Continued)

nut axially relative to the body so that the axial distance between the load shoulder and the lockdown feature can be adjusted.

20 Claims, 5 Drawing Sheets

(56) References Cited

U.S. PATENT DOCUMENTS

| | | | | |
|---|---|---|---|---|
| 6,378,613 | B1 | 4/2002 | Kent et al. | |
| 2004/0245779 | A1 | 12/2004 | Russell | |
| 2005/0279513 | A1 | 12/2005 | Eppink | |
| 2009/0273201 | A1 | 11/2009 | Slack | |
| 2016/0265298 | A1* | 9/2016 | Nguyen | E21B 33/04 |

* cited by examiner

COILED PISTON ASSEMBLY

The present disclosure is directed to a coiled piston assembly per se, and to a coiled piston assembly for use in a wellhead system which includes a tubing hanger that is landed and locked in a wellhead positioned at the upper end of a well bore. In particular, the coiled piston assembly is mounted on the tubing hanger and is used to adjust the vertical position of the tubing hanger load shoulder so that the vertical distance between the load shoulder and the tubing hanger lockdown mechanism is the same as the vertical distance between the seat on which the load shoulder is landed and the locking profile in the bore of the wellhead which the lockdown mechanism is configured to engage. The present disclosure is also directed to a coiled piston assembly for use in securing an inner member to an outer member which surrounds at least a portion of the inner member.

BACKGROUND OF THE DISCLOSURE

Subsea hydrocarbon production systems typically include a wellhead which is positioned at the upper end of a well bore. The wellhead comprises a central bore within which a number of casing hangers are landed. Each casing hanger is connected to the top of a corresponding one of a number of concentric, successively smaller casing strings which extend into the well bore, with the uppermost casing hanger being connected to the innermost casing string. After the innermost casing string is installed, a tubing string is run into the well bore. The top of the tubing string is connected to a tubing hanger having a downward facing circumferential load shoulder which lands on a seat formed at the top of the uppermost casing hanger. In certain tubing hangers, the load shoulder is formed on a load nut which is threadedly connected to the tubing hanger body.

The tubing hanger is usually secured to the wellhead using a lockdown mechanism, such as a lock ring or a number of locking dogs, both of which comprise a number of axially spaced, circumferential locking ridges. The locking dogs are supported on the tubing hanger body and are expandable radially outwardly into a locking profile formed in the bore of the wellhead, such as a number of axially spaced, circumferential locking grooves, each of which is configured to receive a corresponding locking ridge. In order to ensure that the tubing hanger is properly locked to the wellhead, the vertical distance between the load shoulder and the locking dogs must be the same as the vertical distance between the seat and the locking profile, which is commonly referred to as the wellhead space-out. In this regard, the term "the same as" should be interpreted to mean that the vertical distance between the seat and the locking profile is such that the locking ridges can fully engage their corresponding locking grooves. In tubing hangers in which the load shoulder is formed on a load nut that is threadedly connected to the tubing hanger body, the vertical distance between the load shoulder and the locking dogs can be adjusted by rotating the load nut relative to the tubing hanger body. Thus, once the wellhead space-out is determined, the load nut can be rotated until the vertical distance between the load shoulder and the locking dogs is the same as the wellhead space-out.

In the prior art, a lead impression tool (LIT) is sometimes used to measure the wellhead space-out. In subsea wellheads, the LIT is lowered on a drill string and landed on the seat. The LIT is then hydraulically actuated to press typically three circumferentially spaced lead impression pads into the locking profile. After the impressions are taken, the LIT is retrieved to the surface and mounted on a storage/test stand, which is then manually adjusted to match the lead impression tool. The tubing hanger is then mounted on the storage/test stand and the load nut is adjusted until the vertical distance between the load shoulder and the locking dogs is the same as the wellhead space-out.

Although the LIT provides a useful means for determining the wellhead space-out, the time required to run and retrieve the LIT can be relatively long, especially in deep water. Also, setting the tubing hanger on the storage/test stand and adjusting the load nut can be a time consuming process and is dependent on human interpretation.

SUMMARY OF THE DISCLOSURE

In accordance with one embodiment of the present disclosure, a tubing hanger assembly is provided which includes a body which comprises an annular outer surface; a lockdown feature which is located on the body; a load nut which is threadedly connected to the body, the load nut comprising a downward facing load shoulder; and a piston assembly. This piston assembly includes an elongated cylinder which is positioned circumferentially around the outer surface of the body axially adjacent the load nut, the cylinder comprising a first cylinder end which is connected to the body and an open second cylinder end; an elongated piston which is slidably received in the cylinder, the piston comprising a first piston end which is oriented toward the first cylinder end and a second piston end which is configured to extend through the second cylinder end and engage the load nut such that extension of the piston causes the load nut to rotate relative to the body; and a seal which is positioned between the piston and the cylinder to thereby define a piston chamber between the first cylinder end and the first piston end, the piston chamber being connectable to a source of fluid pressure. In operation of the piston assembly, the piston rotates the load nut to thereby move the load nut axially relative to the body. In this manner, an axial distance between the load shoulder and the lockdown feature is adjustable.

In accordance with one aspect of the disclosure, the piston and the cylinder may each comprise a helical configuration. In addition, the piston may comprise at least two winds.

In accordance with another aspect of the disclosure, the body may include a first outer surface portion comprising a first diameter and an axially adjacent second outer surface portion comprising a second diameter which is less than the first diameter, and the piston assembly may be positioned around the second outer surface portion. For example, the piston assembly may be positioned between the first outer surface portion and the load nut.

In accordance with a further aspect of the disclosure, the load nut may comprise an end surface located opposite the load shoulder and a contact surface which extends generally axially from the end surface, and the second piston end may be configured to engage the contact surface.

In accordance with an additional aspect of the disclosure, the first outer surface portion may comprise a recess which defines a radially extending mounting surface to which the first cylinder end is connected.

In accordance with another aspect of the disclosure, the body may include a fluid conduit which is connectable to the source of fluid pressure and comprises a first conduit end that terminates at the mounting surface, and the first cylinder end may be connected to the first conduit end via a fluid coupling.

In accordance with a further aspect of the disclosure, the tubing hanger assembly may be configured to be installed in a wellhead which comprises a central bore in which a casing hanger is positioned, and the load shoulder may be configured to land on a seat which is formed on the casing hanger to thereby support the tubing hanger in the wellhead.

In accordance with an additional aspect of the disclosure, the central bore may comprise a locking profile and the lockdown feature may comprise a number of locking dogs which are supported on the body and are expandable into the locking profile to thereby secure the tubing hanger assembly to the wellhead. In operation of the piston assembly, for example, the piston rotates the load nut until a distance between the load shoulder and the locking dogs is the same as a distance between the seat and the locking profile.

The present disclosure is also directed to a method for installing a tubing hanger in a wellhead, the wellhead comprising a first tubing hanger lockdown feature and a central bore in which a casing hanger is positioned, and the tubing hanger comprising a second tubing hanger lockdown feature which is configured to engage the first tubing hanger lockdown feature, an annular body, and a load nut which is threadedly connected to the body, the load nut comprising a downward facing load shoulder which is configured to land on a seat that is formed on the casing hanger. The method comprises the steps of lowering the tubing hanger into the wellhead; and then adjusting the axial position of the load nut until an axial distance between the load shoulder and the second tubing hanger lockdown feature is the same as a second axial distance between the seat and the first tubing hanger lockdown feature.

In accordance with another aspect of the disclosure, the method may also comprise the step of engaging the first and second tubing hanger lockdown features to thereby secure the tubing hanger to the wellhead.

In accordance with a further aspect of the disclosure, the step of engaging the first tubing hanger lockdown feature with the second tubing hanger lockdown feature may be performed prior to the step of adjusting the axial position of the load nut.

In accordance with yet another aspect of the disclosure, the tubing hanger further comprises a piston assembly which is positioned circumferentially around the body, the piston assembly comprising an elongated cylinder which is connected to the body and an elongated piston which is slidably received in the cylinder and is configured to extend from the cylinder and engage the load nut such that extension of the piston causes the load nut to rotate relative to the body. In addition, the step of adjusting the axial position of the load nut is performed by operating the piston assembly.

The present disclosure is also directed to a piston assembly which includes a helical cylinder which comprises first and second cylinder ends; a helical piston which is slidably received in the cylinder, the piston comprising a first piston end which is oriented toward the first cylinder end and a second piston end which is configured to extend through the second cylinder end; and a seal which is positioned between the piston and the cylinder to thereby define a piston chamber between the first cylinder end and the first piston end; wherein in operation of the piston assembly, pressurization of the piston chamber forces the piston to extend from the cylinder.

The present disclosure is further directed to a piston assembly for use in securing an inner member to an outer member which surrounds at least a portion of the inner member, the inner member comprising first and second axially spaced inner features and the outer member comprising first and second axially spaced outer features which are configured to engage the first and second inner features, respectively, to secure the inner member to the outer member, one of the first inner feature and the first outer feature being formed on a load nut which is threadedly connected to one of the inner member and the outer member such that rotation of the load nut relative to said one of the inner member and the outer member moves the load nut axially relative to said one of the inner member and the outer member. In this embodiment, the piston assembly comprises a helical cylinder which is positioned around said one of the inner member and the outer member to which the load nut is connected, the cylinder comprising first and second cylinder ends, the first cylinder end being connected to said one of the inner member and the outer member to which the load nut is connected; and a helical piston which is slidably received in the cylinder, the piston comprising a first piston end which is oriented toward the first cylinder end and a second piston end which is configured to extend through the second cylinder end and engage the load nut wherein with the second inner feature engaged with the second outer feature, the piston assembly is operable to rotate the load nut to thereby move the first inner feature into engagement with the first outer feature to thereby secure the inner member to the outer member.

In accordance with another aspect of the disclosure, the piston assembly further comprises a piston chamber which is formed between the first cylinder end and the first piston end; wherein the piston chamber is selectively connected to a source of fluid pressure to thereby operate the piston assembly.

The present disclosure is also directed to a method for securing an inner member to an outer member which surrounds at least a portion of the inner member, the inner member comprising first and second axially spaced inner features and the outer member comprising first and second axially spaced outer features which are configured to engage the first and second inner features, respectively, to secure the inner member to the outer member, one of the first inner feature and the first outer feature being formed on a load nut which is threadedly connected to one of the inner member and the outer member such that rotation of the load nut relative to said one of the inner member and the outer member moves the load nut axially relative to said one of the inner member and the outer member. In this embodiment, the method comprises the steps of providing a piston assembly which comprises a helical cylinder which is positioned around said one of the inner member and the outer member to which the load nut is connected, the cylinder comprising first and second cylinder ends, the first cylinder end being connected to said one of the inner member and the outer member to which the load nut is connected; and a helical piston which is slidably received in the cylinder, the piston comprising a first piston end which is oriented toward the first cylinder end and a second piston end which is configured to extend through the second cylinder end and engage the load nut; inserting the inner member into the outer member until the second inner feature engages the second outer feature; and operating the piston assembly to rotate the load nut to thereby move the first inner feature into engagement with the first outer feature to thereby secure the inner member to the outer member.

In accordance with an aspect of the disclosure, prior to the step of operating the piston assembly to rotate the load nut to thereby move the first inner feature into engagement with the first outer feature, the method may also comprise the step of applying a preload force on the inner member in a direction opposite to a direction in which the inner member is inserted into the outer member.

Thus, in one illustrative embodiment of the disclosure, the tubing hanger and coiled piston assembly enables the vertical spacing between the load shoulder and the locking dogs to be adjusted in real time as the tubing hanger is landed and locked in the wellhead. As a result, the need to measure the wellhead space-out and adjust the position of the load nut before the tubing hanger is run into the wellhead is eliminated, which greatly reduces the time required to install the tubing hanger.

These and other objects and advantages of the present invention will be made apparent from the following detailed description, with reference to the accompanying drawings. In the drawings, the same reference numbers may be used to denote similar components in the various embodiments.

DETAILED DESCRIPTION

Figure 1:
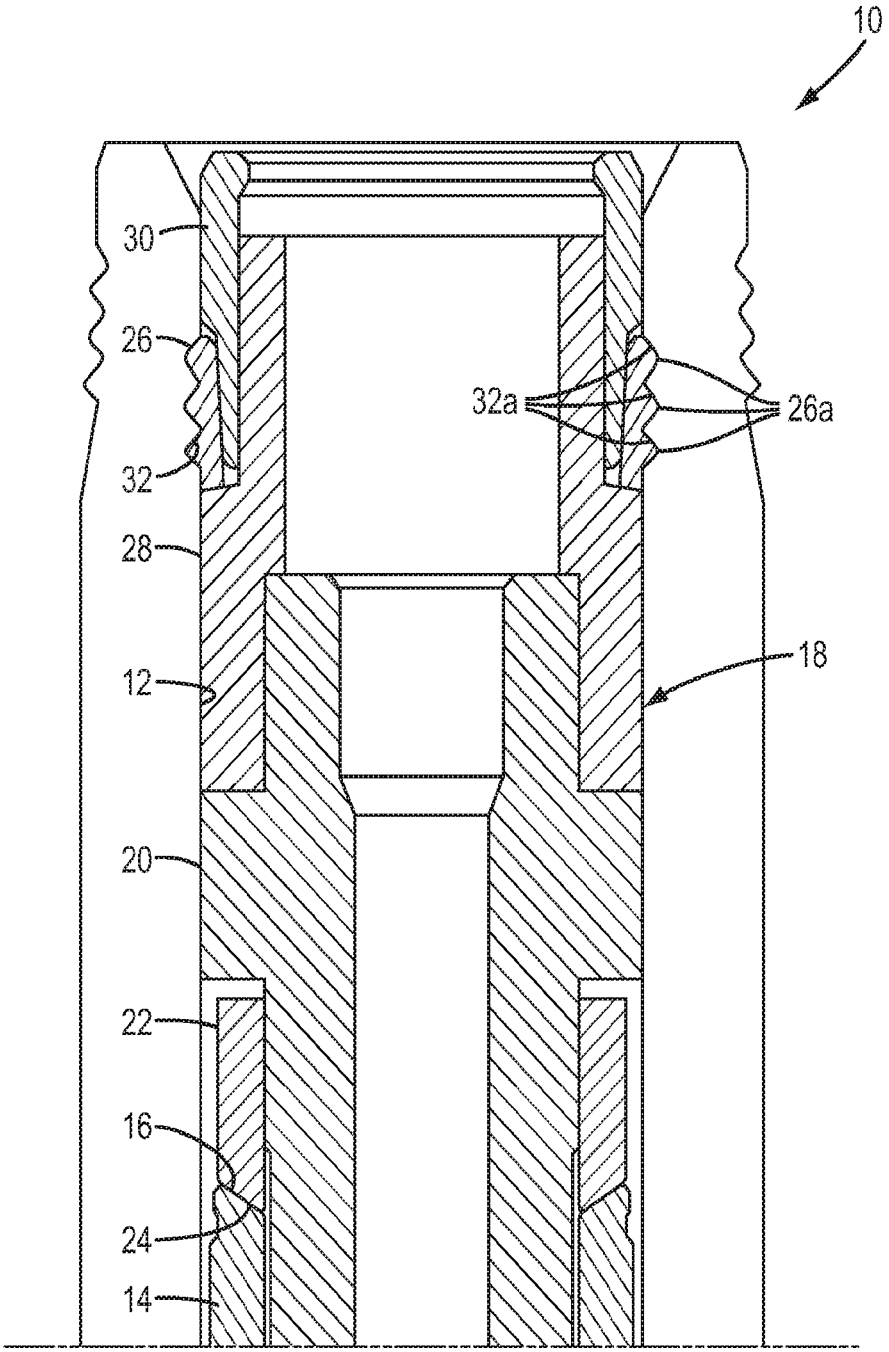
FIG. 1 is a cross sectional view of an example of a prior art wellhead system.

An example of a prior art wellhead system is shown in FIG. 1. The wellhead system includes a wellhead 10 (only the upper portion of which is shown) which is positioned at the top of a well bore (not shown). The wellhead 10 comprises a central bore 12 within which a number of casing hangers are landed, including an uppermost casing hanger 14 (only the upper portion of which is shown). The top of the casing hanger 14 is configured as a seat 16 on which a tubing hanger 18 is landed. The tubing hanger 18 includes a cylindrical body 20 and a load nut 22 which is threadedly connected to the body. The load nut 22 comprises a load shoulder 24 which engages the seat 16 when the tubing hanger 18 is landed in the wellhead 10. A lock ring or a number of expandable locking dogs 26 are supported on a lockdown ring 28 which is connected to the tubing hanger body 20. After the tubing hanger 18 is landed in the wellhead 10, a locking mandrel 30 is actuated to drive the locking dogs 26 into a locking profile 32 which is formed in the central bore 12. This action forces a number of axially spaced, circumferential locking ridges 26*a* formed on the locking dogs 26 into a corresponding number of axially spaced, circumferential locking ridges 32*a* formed in the locking profile 32 to thereby secure the tubing hanger to the wellhead. Due to the threaded connection between the load nut 22 and the tubing hanger body 20, the vertical distance between the load shoulder 24 and the locking dogs 26 can be adjusted by rotating the load nut relative to the body.

As discussed above, in order to ensure that the tubing hanger 18 is properly locked to the wellhead 10, the vertical distance between the load shoulder 24 and the locking dogs 26 must be the same as the vertical distance between the seat 16 and the locking profile 32 (i.e., the wellhead space-out). The wellhead space-out may be determined using, e.g., a lead impression tool (LIT). In the wellhead system shown in FIG. 1, for example, the LIT would be lowered on a drill string and landed on the seat 16. The LIT would then be actuated to press a number of circumferentially spaced lead impression pads into the locking profile 32. After the impressions are taken, the LIT would be retrieved to the surface and mounted on a storage/test stand, which would then be manually adjusted to match the LIT. After this step, the tubing hanger 18 would be mounted on the storage/test stand and the load nut 22 would be manually rotated until the vertical distance between the load shoulder 24 and the locking dogs 26 is the same as the vertical distance between the seat and the locking profile. As may be apparent, this method for determining the wellhead space-out and adjusting the load nut until the vertical distance between the load shoulder and the locking dogs is the same as the wellhead space-out is a relatively time consuming process.

In accordance with the present disclosure, a tubing hanger and coiled piston assembly is provided which enables the vertical spacing between the load shoulder and the locking dogs to be adjusted in real time as the tubing hanger is landed and locked in the wellhead. As a result, the need to measure the wellhead space-out and adjust the position of the load nut before the tubing hanger is run into the wellhead is eliminated, which greatly reduces the time required to install the tubing hanger. Although the coiled piston assembly disclosed herein is particularly useful for the above purpose, it may be used in a variety of applications. Therefore, the present disclosure is also directed to the coiled piston assembly per se. For purposes of brevity, however, the coiled piston assembly will be described hereafter in the context of a tubing hanger assembly for a subsea hydrocarbon wellhead system. Nevertheless, persons of ordinary skill in the art will readily understand from the following description how the coiled piston assembly may be adapted for use in other applications.

Figure 2:
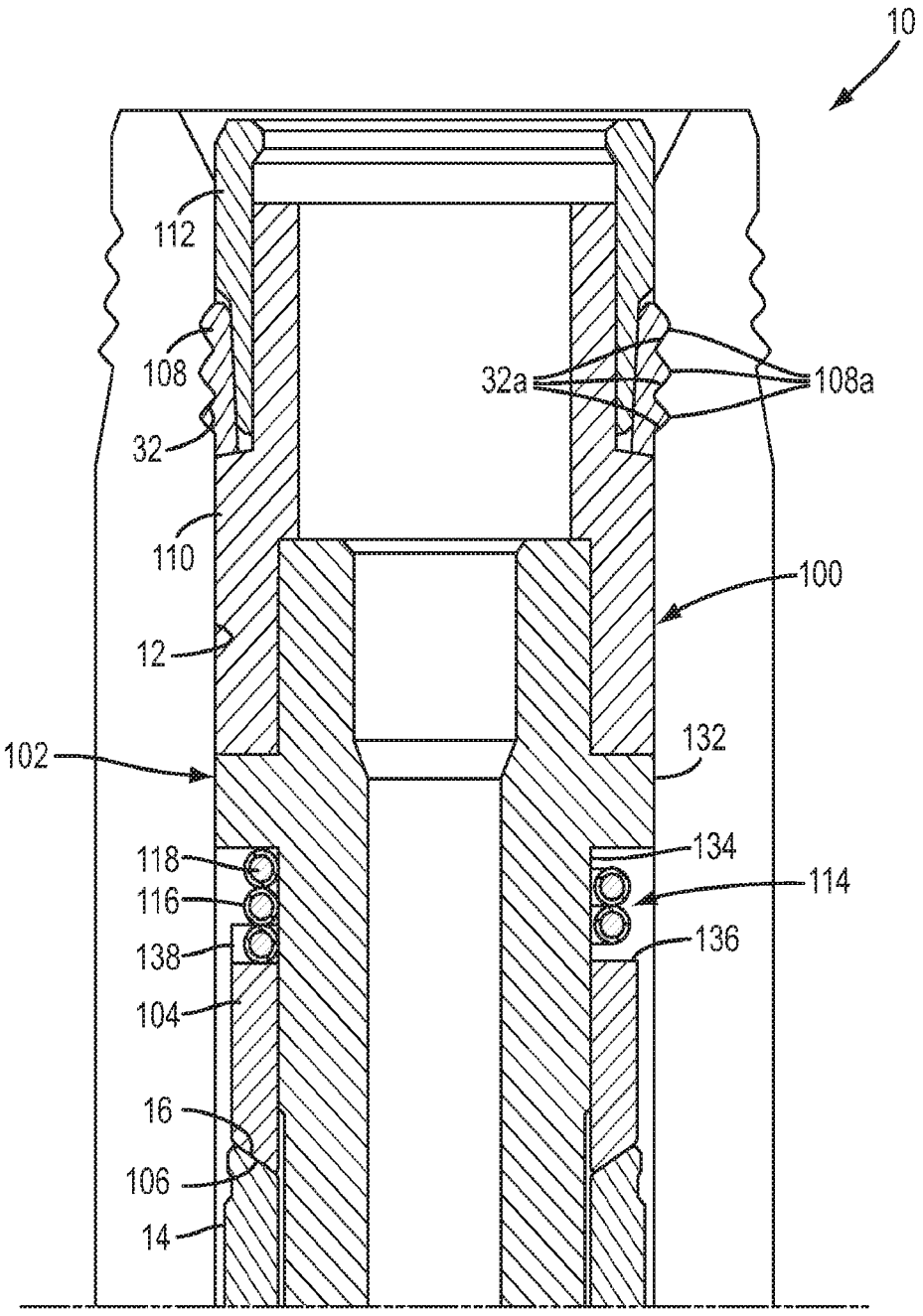
FIG. 2 is a cross sectional view of a wellhead system comprising an illustrative embodiment of the tubing hanger and coiled piston assembly of the present disclosure.

An illustrative embodiment of a tubing hanger and coiled piston assembly of the present disclosure will now be described with reference to FIGS. 2-4. As shown in FIG. 2, the tubing hanger, which is indicated generally by reference number 100, is shown installed in a representative wellhead 10. Similar to the example described above in connection with FIG. 1, the wellhead 10 comprises a central bore 12 within which a number of casing hangers are landed, including an uppermost casing hanger 14 (only the upper portion of which is shown). In this example, the top of the casing hanger 14 is configured as an upward facing seat 16 on which the tubing hanger 100 is landed.

Figure 3:
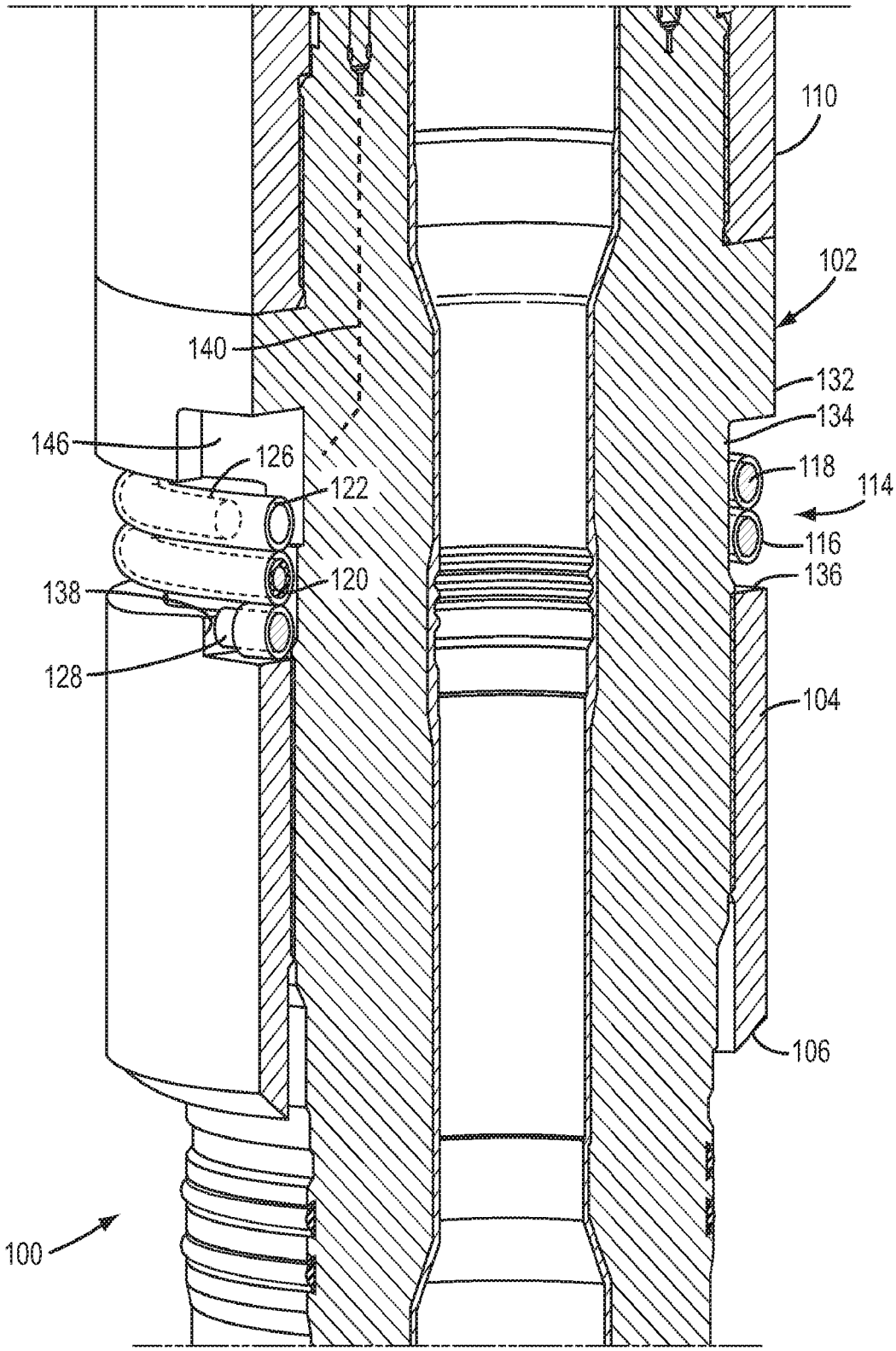
FIG. 3 is a cross sectional perspective view of a portion of the tubing hanger and coiled piston assembly shown in FIG. 2.
Figure 4:
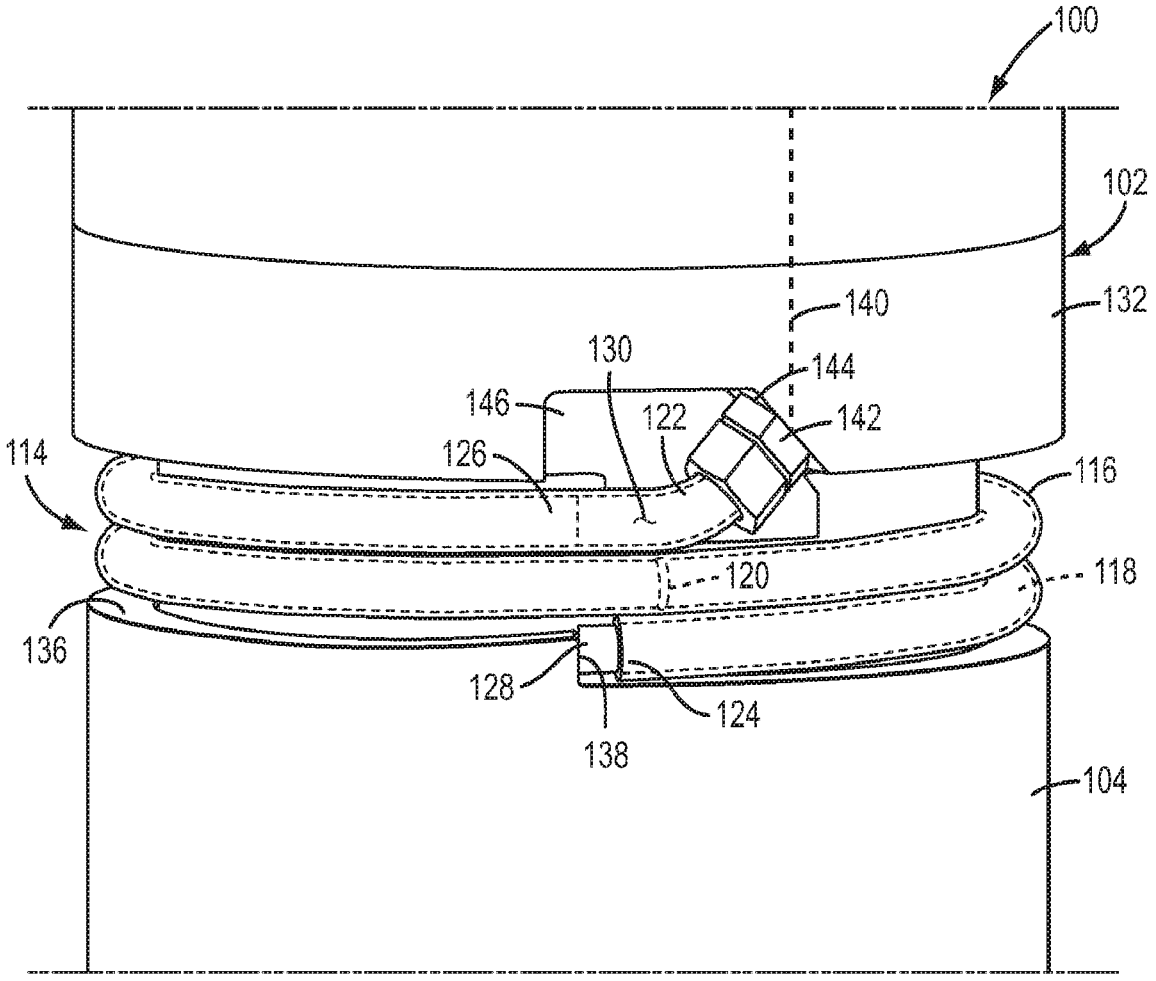
FIG. 4 is an enlarged perspective view of a portion of the tubing hanger and coiled piston assembly shown in FIG. 3.

Referring also to FIGS. 3 and 4, the tubing hanger 100 includes an axially extending body 102 comprising an annular outer surface. A load nut 104 is threadedly connected to the body 102 and includes a downward facing load shoulder 106 which engages the seat 16 when the tubing hanger 100 is landed in the wellhead 10. Due to the threaded connection between the load nut 104 and the body 102, rotation of the load nut relative to the body will result in axial displacement of the load nut relative to the body.

The tubing hanger 100 is secured to the wellhead 10 by engagement of interacting lockdown features on the tubing hanger and the wellhead. The lockdown features may comprise any suitable means for securing the tubing hanger to the wellhead. For example, the wellhead may comprise a locking profile in the central bore which is engaged by a lock ring carried on the tubing hanger or on a separate lockdown mandrel or similar device. As another example, the tubing hanger may comprise a locking profile on the outer surface which is engaged by a number of locking pins or similar devices mounted on the wellhead. In the example shown in FIG. 2, the tubing hanger lockdown feature comprises a number of expandable locking dogs 108 which are supported on a lockdown ring 110 that is connected to the tubing hanger body 102, and the wellhead lockdown feature comprises a locking profile 32 which is formed in the central bore 12. As with the locking dogs 26 described above, the locking dogs 108 in this example embodiment comprise a number of axially spaced, circumferential locking ridges 108*a* which are configured to be received in the axially spaced, circumferential locking grooves 32*a* of the locking profile 32. In this example, after the tubing hanger 100 is landed in the wellhead 10, a locking mandrel 112 is actuated to drive the locking ridges 108*a* into the locking grooves 32*a* to thereby secure the tubing hanger to the wellhead.

As discussed above, in order to ensure that the tubing hanger 100 is properly locked to the wellhead 10, the vertical distance between the load shoulder 106 and the locking dogs 108 must be the same as the vertical distance between the seat 16 and the locking profile 32. In the prior art, the vertical distance between the load shoulder 106 and the locking dogs 108 was adjusted manually. In accordance with the present disclosure, the vertical distance between the load shoulder 106 and the locking dogs 108 can be adjusted remotely using a novel coiled piston assembly which will now be described.

As shown in FIGS. 2-4, the coiled piston assembly, which is indicated generally by reference number 114, includes an elongated cylinder 116 which is positioned circumferentially around the outer surface of the body 102 axially adjacent the load nut 104, an elongated piston 118 which is slidably received in the cylinder, and a ring-shaped seal 120 which is positioned between the piston and the cylinder. The cylinder 116 comprises a first cylinder end 122 which is connected to the body 102 and an open second cylinder end 124. The piston 118 comprises a first piston end 126 which is oriented toward the first cylinder end 122 and a second piston end 128 which is configured to extend through the second cylinder end and engage the load nut 104. For example, the second piston end 128 may be connected to the load nut 104 by a suitable connector (not shown), or simply configured to bear against the load nut during actuation of the piston assembly 114.

The seal 120, which may be mounted to either the cylinder 116 or the piston 118, defines a piston chamber 130 between the first cylinder end 122 and the first piston end 126. The piston chamber 130 is connectable to a source of fluid pressure (not shown), such as hydraulic fluid, in a manner which will be described below. In operation of the piston assembly 114, the piston chamber 130 is pressurized to force the piston 118 to extend from the cylinder 116. In the example shown in the drawings wherein the cylinder 116 is positioned circumferentially around the body 102, the piston 118 will extend circumferentially relative to the body and generate a torque on the load nut 104 which will cause the load nut to rotate relative to the body. Due to the threaded connection between the load nut 104 and the body 102, this rotation will displace the load nut axially relative to the body and thereby increase the vertical distance between the load shoulder 106 and the locking dogs 108.

In the illustrative embodiment of the piston assembly 114 which is shown in the drawings, the cylinder 116 and the piston 118 each comprise a helical configuration which is wound around the body 102 The piston 118 should be made of a material which is capable of maintaining its helical configuration as it extends from the cylinder 116 and winds around the body 102. The number of winds the helix of the piston 118 is designed to have will depend on the number of turns the load nut 104 must make to achieve the desired maximum axial displacement of the load nut. In the present embodiment, for example, the piston 118 comprises approximately two full winds.

In one embodiment of the tubing hanger 100, the cylinder 116 and the piston 118 are circumferentially aligned with the load nut 104. As shown in FIGS. 2-4, for example, the body 102 includes a first outer surface portion 132 having a first diameter and an axially adjacent second outer surface portion 134 having a second diameter which is less than the first diameter. In this manner, the second outer surface portion 134 defines an annular recessed area between the first outer surface portion 132 and an upper end surface 138 of the load nut 104 within which the piston assembly 114 is positioned. In this embodiment, the second piston end 128 may be configured to engage a contact surface 138 which extends generally axially from the upper end surface 138 of the load nut 104. For example, the second piston end 128 may be connected to or configured to bear against the contact surface 138.

As mentioned above, the piston assembly 114 is operated by communicating fluid pressure to the piston chamber 130 through the first cylinder end 122. In the illustrative embodiment of the tubing hanger 100 shown in FIGS. 3 and 4, the first cylinder end 122 is connected to a fluid conduit 140 (shown in phantom) which extends through the body 102 and is connectable to a source of fluid pressure (not shown). The first cylinder end 122 may be connected to the fluid conduit 140 by any suitable means, such as a fluid coupling 142. In this example, the fluid coupling 142 is connected to an end of the fluid conduit 140 which terminates at a radially extending mounting surface 144 that is defined by a recess 146 formed in the first outer surface portion 132 of the body 102. In order to actuate the piston assembly 114 to rotate the load nut 104, fluid pressure is communicated to the piston chamber 130 to force the piston 118 out of the cylinder 116. As the piston 118 extends circumferentially from the cylinder 116 and winds down around the body 102, the second piston end 128 will generate a torque on the load nut 104 which will cause the load nut to rotate relative to the body. Since the load nut 104 is threadedly connected to the body 102, this rotation will cause the load nut to displace axially relative to the body and thereby increase the vertical distance between the load shoulder 106 and the locking dogs 108.

The present disclosure is also directed to a method for installing a tubing hanger in a wellhead, such as the wellhead 10 described above. With reference again to FIG. 2, the wellhead 10 comprises a first tubing hanger lockdown feature, such as a locking profile 32, and a central bore 10 in which a casing hanger 104 is positioned. The tubing hanger, which may be similar to the tubing hanger 100 described above, comprises a second tubing hanger lockdown feature, such as a number of locking dogs 108, which is configured to engage the first tubing hanger lockdown feature, an annular body 102, and a load nut 104 which is threadedly connected to the body. The load nut 104 comprises a downward facing load shoulder 106 which is configured to land on a seat 16 that is formed on the casing hanger 104.

The method for installing the tubing hanger 100 in the wellhead 10 comprises the steps of lowering the tubing hanger into the wellhead, and then adjusting the axial position of the load nut 104 until an axial distance between the load shoulder 106 and the second tubing hanger lockdown feature 108 is the same as the axial distance between the seat 16 and the first tubing hanger lockdown feature 32. The method also comprises the step of engaging the first and second tubing hanger lockdown features 32, 108 to thereby secure the tubing hanger to the wellhead. This step of engaging the first and second tubing hanger lockdown features 32, 108 may be performed prior to the step of adjusting the axial position of the load nut.

The method may further comprise the steps of, after the load shoulder 106 is landed on the seat 16 and the first and second lockdown features 32, 108 are engaged, applying a tension to the tubing hanger 100 to obtain a desired preload between the first and second lockdown features, then adjusting the axial position of the load nut 104 until the load shoulder once again engages the seat, and then relieving the tension on the tubing hanger. This action will create a preload between the first and second lockdown features 32, 108 which will tend to rigidize the tubing hanger 100 within the wellhead 10. In accordance with one embodiment of the present disclosure, the step of adjusting the axial position of the load nut is performed using the piston assembly 114 described above.

Thus, the tubing hanger 100 and coiled piston assembly 114 enables the vertical spacing between the load shoulder 106 and the locking dogs 108 to be adjusted in real time as the tubing hanger is landed and locked in the wellhead 10. As a result, the need to measure the wellhead space-out and adjust the position of the load nut 104 before the tubing hanger is run into the wellhead is eliminated, which greatly reduces the time required to install the tubing hanger.

In the illustrative embodiment of the tubing hanger and coiled piston assembly shown in the drawings, the cylinder 116 of the coiled piston assembly 114 is positioned axially adjacent the load nut 104. However, it should be understood that the tubing hanger and coiled piston assembly could be designed such that the cylinder 116 is positioned otherwise relative to the load nut 104. For example, the cylinder 116 could be positioned coaxially around the load nut 104. In other applications in which an adjustable load nut may comprise outer threads that engage the inner threads of a surrounding member, the cylinder 116 could be positioned coaxially within the load nut. In each of these examples, the cylinder 116 is considered to be located adjacent the load nut.

Also, although the coiled piston assembly 114 has been described herein in the context of a tubing hanger which is landed on a casing hanger supported in a wellhead, it should be understood that the coiled piston assembly could be used in other applications, either within or outside of the field of subsea hydrocarbon production systems. In the field of subsea hydrocarbon production systems, for example, the coiled piston assembly 114 could be used to obtain proper spacing between any tubular hanger and any component within which the tubular hanger is landed, such as, e.g., a tubing spool or tubing head.

More generally, the present disclosure provides a coiled piston assembly for use in securing an inner member to an outer member that surrounds at least a portion of the inner member. In one embodiment, the outer member comprises first and second axially spaced outer features and the inner member comprises first and second axially spaced inner features which are configured to engage the outer features to secure the inner member to the outer member. The first inner feature is formed on a component which is threadedly connected to the inner member, and the coiled piston assembly is operable to rotate the component to thereby move the first inner feature axially relative to the inner member until the first and second inner features engage the first and second outer features, respectively, to secure the inner member to the outer member. Alternatively, the first outer feature may be formed on a component which is threadedly connected to the outer member, and the coiled piston assembly may be operable to rotate the component to thereby move the first outer feature axially relative to the outer member until the first and second inner features engage the first and second outer features, respectively, to secure the inner member to the outer member.

Figure 5B:
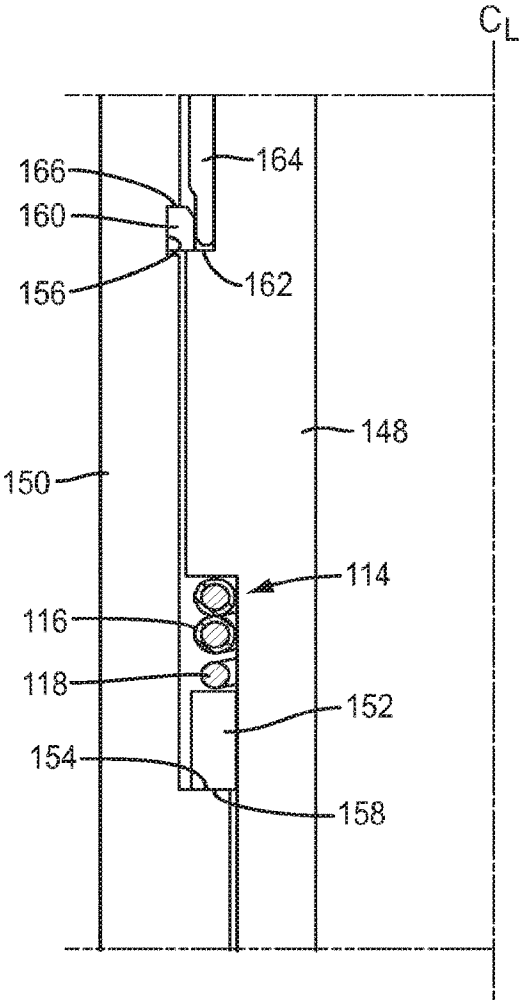
FIG. 5B is a partial cross sectional representation similar to FIG. 5A, but showing the coiled piston assembly being used to preload the locking feature securing the inner member to the outer member.
Figure 5A:
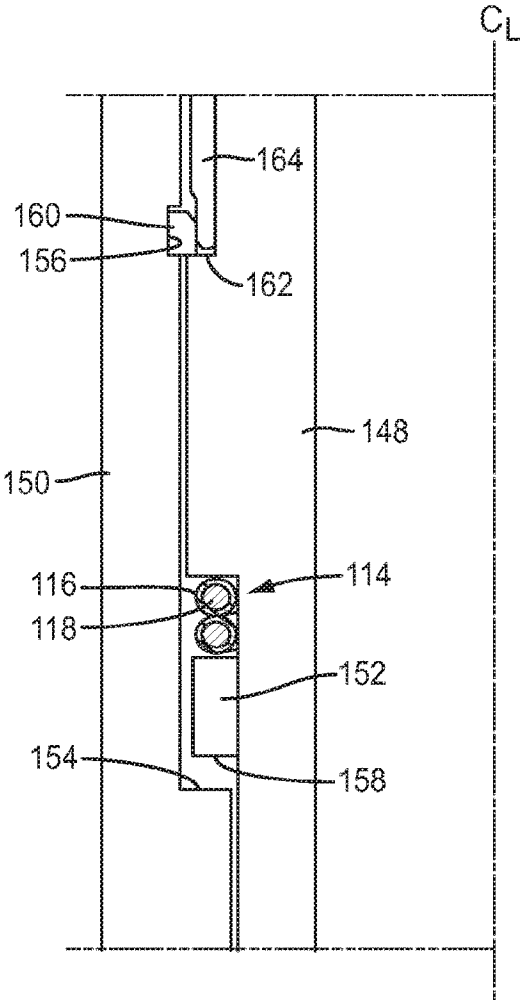
FIG. 5A is a partial cross sectional representation of an embodiment of the coiled piston assembly of the present disclosure shown mounted on an inner member that is surrounded by and secured to an outer member.

Referring to FIGS. 5A and 5B, for example, the coiled piston assembly 114 is shown in conjunction with an inner member 148 which is positioned adjacent an outer member 150. In this illustrative embodiment, the outer member 150 surrounds at least a portion of the inner member 148. In addition, although the inner and outer members 148, 150 may comprise any practical configuration, in FIGS. 5A and 5B they are each shown to comprise a tubular configuration having a centerline CL. In this embodiment, the coiled piston assembly 114 is mounted to the inner member 148 adjacent a load nut 152 which is threadedly connected to an outer surface of the inner member such that rotation of the load nut relative to the inner member will result in axial translation of the load nut relative to the inner member. Although not specifically illustrated in FIGS. 5A and 5B, similar to the embodiment shown in FIGS. 2-4, the coiled piston assembly 114 includes a cylinder 116 which is connected to the inner member 148, a piston 118 which engages the load nut 152, and a piston chamber 130 which is formed between the first end 122 of the cylinder and the first end 126 of the piston and is connected to a source of pressurized fluid for selective actuation of the piston assembly.

In accordance with the present embodiment, the outer member 152 comprises first and second axially spaced outer features and the inner member 148 comprises first and second axially spaced inner features which are configured to engage the outer features in order to secure the inner member to the outer member. For example, the first outer feature may comprise a seat 154 which is formed on an inner surface of the outer member 150, and the second outer feature may comprise a circumferential groove 156 which is formed on the inner surface of the outer member axially above the seat. Also, the first inner feature may comprise a shoulder 158 which is formed on an axially lower end of the load nut 152, and the second inner feature may comprise a lock ring 160 which is supported on a circular ledge 162 that is formed on an outer surface of the inner member 148 axially above the load nut.

In accordance with an exemplary method for securing the inner member 148 to the outer member 150, the inner member is inserted into the outer member until the lock ring 160 is positioned adjacent the groove 156. The lock ring 160 is then forced radially outwardly into the groove 156 by means of, e.g., a locking mandrel 164. The coiled piston assembly 114 may then be activated to rotate the load nut 152 relative to the inner member 148 to thereby move the load nut axially downward until the shoulder 158 engages the seat 154.

In accordance with an alternative method for securing the inner member 148 to the outer member 150, once the inner member is inserted into the outer member and the lock ring 160 is positioned in the groove 156, a force is applied to the inner member in a direction opposite to the direction of insertion. As shown in FIG. 5B, this action will cause the ledge 162 on the inner member 148 to force the lock ring 160 against an upper shoulder 166 defined the groove 156 to thereby preload the lock ring against the groove. While maintaining the force on the inner member 148, the coiled piston assembly 114 may then be activated to move the load nut 152 axially downward until the shoulder 158 engages the seat 154.

The embodiment shown in FIGS. 5A and 5B is particularly useful where both the first and second outer features are formed in the outer member 150. For example, in the tubing head component of a subsea hydrocarbon production system, both the seat on which the tubing hanger is landed and the locking profile for the tubing hanger lockdown mechanism are machined into the axial bore of the tubing head. Thus, during the manufacturing process tight tolerances must be maintained in order to ensure that the axial distance between the seat and the locking profile meets the required specifications. With the embodiment shown in FIGS. 5A and 5B, however, the manufacturing tolerances can be loosened, because any variation in the axial distance between the seat and the locking profile can be corrected by adjusting the position of the load nut 152 with the coiled piston assembly 114.

Figure 6:
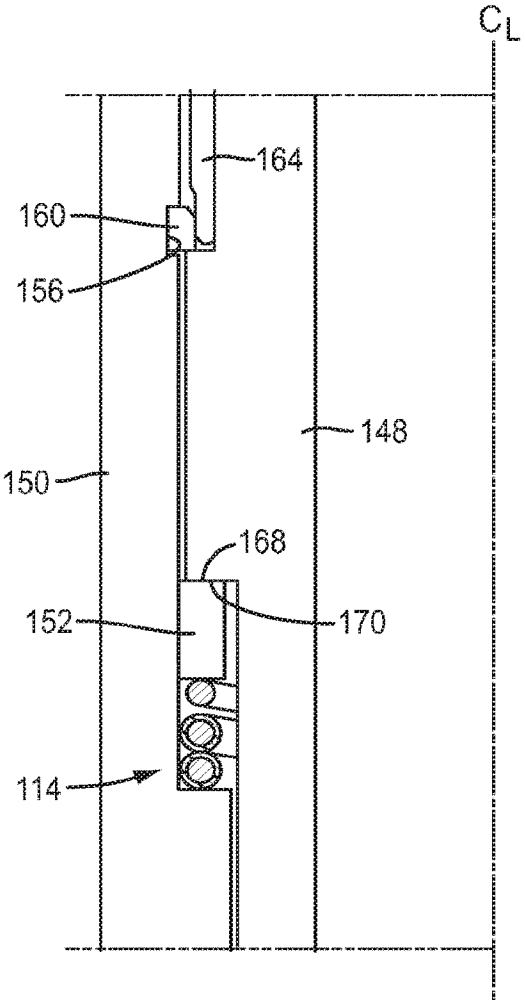
FIG. 6 is a partial cross sectional representation of another embodiment of the coiled piston assembly of the present disclosure shown mounted on an outer member that surrounds and is secured to an inner member, wherein the coiled piston assembly is shown being used to preload the locking feature securing the outer member to the inner member.

In an alternative embodiment of the present disclosure which is shown in FIG. 6, the load nut 152 is threadedly connected to an inner surface of the outer member 150 and the coiled piston assembly 114 is mounted to the outer member adjacent the load nut. In this embodiment, the first outer feature comprises a seat 168 which is formed on an axially upper end of the load nut 152, and the second outer feature comprises a groove 156 which is formed on the inner surface of the outer member 150 axially above the seat. Also, the first inner feature comprises a circumferential shoulder 170 which is formed on the outer surface of the inner member 148, and the second inner feature comprises a lock ring 160 which is supported on the outer surface of the inner member axially above the shoulder. Although not specifically shown, the coiled piston assembly 114 includes a cylinder 116 which is connected to the outer member 150, a piston 118 which engages the load nut 152, and a piston chamber 130 which is formed between the first end 122 of the cylinder and the first end 126 of the piston and is connected to a source of pressurized fluid for selective actuation of the piston assembly.

In order to secure the inner member 148 to the outer member 150 in the embodiment shown in FIG. 6, the inner member is inserted into the outer member until the lock ring 160 is positioned adjacent the groove 156. The lock ring 160 is then forced radially outwardly into the groove 156 by, e.g., a locking mandrel 164. The coiled piston assembly 114 may then be activated to rotate the load nut 152 relative to the outer member 150 to thereby move the load nut axially upward until the seat 168 engages the shoulder 170. Alternatively, once the inner member 148 is inserted into the outer member 150 and the lock ring 160 is positioned in the groove 156, a force may be applied to the inner member in a direction opposite to the direction of insertion in order to preload the lock ring against the groove. While maintaining the force on the inner member 148, the coiled piston assembly 114 may then be activated to move the load nut 152 axially upward until the seat 168 engages the shoulder 170.

It should be recognized that, while the present disclosure has been presented with reference to certain embodiments, those skilled in the art may develop a wide variation of structural and operational details without departing from the principles of the disclosure. For example, the various elements shown in the different embodiments may be combined in a manner not illustrated above. Therefore, the following claims are to be construed to cover all equivalents falling within the true scope and spirit of the disclosure.

What is claimed is:

1. A tubing hanger assembly which includes:
- a body which comprises an annular outer surface;
- a lockdown feature which is located on the body;
- a load nut which is threadedly connected to the body, the load nut comprising a downward facing load shoulder; and
- a piston assembly which includes:
  - an elongated cylinder which is positioned circumferentially around the outer surface of the body axially adjacent the load nut, the cylinder comprising a first cylinder end which is connected to the body and an open second cylinder end;
  - an elongated piston which is slidably received in the cylinder, the piston comprising a first piston end which is oriented toward the first cylinder end and a second piston end which is configured to extend through the second cylinder end and engage the load nut such that extension of the piston causes the load nut to rotate relative to the body; and
  - a seal which is positioned between the piston and the cylinder to thereby define a piston chamber between the first cylinder end and the first piston end, the piston chamber being connectable to a source of fluid pressure;
- wherein in operation of the piston assembly, the piston rotates the load nut to thereby move the load nut axially relative to the body;
- whereby an axial distance between the load shoulder and the lockdown feature is adjustable.

2. The tubing hanger assembly of claim 1, wherein the piston and the cylinder each comprise a helical configuration.

3. The tubing hanger assembly of claim 2, wherein the piston comprises at least two winds.

4. The tubing hanger assembly of claim 2, wherein the body includes a first outer surface portion comprising a first diameter and an axially adjacent second outer surface portion comprising a second diameter which is less than the first diameter, and wherein the piston assembly is positioned around the second outer surface portion.

5. The tubing hanger assembly of claim 4, wherein the piston assembly is positioned between the first outer surface portion and the load nut.

6. The tubing hanger assembly of claim 5, wherein the load nut comprises an end surface located opposite the load shoulder and a contact surface which extends generally axially from the end surface, and wherein the second piston end is configured to engage the contact surface.

7. The tubing hanger assembly of claim 5, wherein the first outer surface portion comprises a recess which defines a radially extending mounting surface to which the first cylinder end is connected.

8. The tubing hanger assembly of claim 7, wherein the body includes a fluid conduit which is connectable to the source of fluid pressure and comprises a first conduit end that terminates at the mounting surface, and wherein the first cylinder end is connected to the first conduit end via a fluid coupling.

9. The tubing hanger assembly of claim 1, wherein the tubing hanger assembly is configured to be installed in a wellhead which comprises a central bore in which a casing hanger is positioned, the load shoulder being configured to land on a seat which is formed on the casing hanger to thereby support the tubing hanger in the wellhead.

10. The tubing hanger assembly of claim 9, wherein the central bore comprises a locking profile and the lockdown feature comprises a number of locking dogs which are supported on the body and are expandable into the locking profile to thereby secure the tubing hanger assembly to the wellhead.

11. The tubing hanger assembly of claim 10, wherein in operation of the piston assembly, the piston rotates the load nut until a distance between the load shoulder and the locking dogs is the same as a distance between the seat and the locking profile.

12. A method for installing a tubing hanger in a wellhead, the wellhead comprising a first tubing hanger lockdown feature and a central bore in which a casing hanger is positioned, and the tubing hanger comprising a second tubing hanger lockdown feature which is configured to engage the first tubing hanger lockdown feature, an annular body, and a load nut which is threadedly connected to the body, the load nut comprising a downward facing load shoulder which is configured to land on a seat that is formed on the casing hanger, the method comprising:

lowering the tubing hanger into the wellhead; and then adjusting the axial position of the load nut until an axial distance between the load shoulder and the second tubing hanger lockdown feature is the same as a second axial distance between the seat and the first tubing hanger lockdown feature.

13. The method of claim 12, further comprising engaging the first and second tubing hanger lockdown features to thereby secure the tubing hanger to the wellhead.

14. The method of claim 13, wherein the step of engaging the first tubing hanger lockdown feature with the second tubing hanger lockdown feature is performed prior to the step of adjusting the axial position of the load nut.

15. The method of claim 12, wherein the tubing hanger further comprises a piston assembly which is positioned circumferentially around the body, the piston assembly comprising an elongated cylinder which is connected to the body and an elongated piston which is slidably received in the cylinder and is configured to extend from the cylinder and engage the load nut such that extension of the piston causes the load nut to rotate relative to the body, and wherein the step of adjusting the axial position of the load nut is performed by operating the piston assembly.

16. A piston assembly which includes:

a helical cylinder which comprises first and second cylinder ends;

a helical piston which is slidably received in the cylinder, the piston comprising a first piston end which is oriented toward the first cylinder end and a second piston end which is configured to extend through the second cylinder end; and a seal which is positioned between the piston and the cylinder to thereby define a piston chamber between the first cylinder end and the first piston end;

wherein in operation of the piston assembly, pressurization of the piston chamber forces the piston to extend from the cylinder.

17. A piston assembly for use in securing an inner member to an outer member which surrounds at least a portion of the inner member, the inner member comprising first and second axially spaced inner features and the outer member comprising first and second axially spaced outer features which are configured to engage the first and second inner features, respectively, to secure the inner member to the outer member, one of the first inner feature and the first outer feature being formed on a load nut which is threadedly connected to one of the inner member and the outer member such that rotation of the load nut relative to said one of the inner member and the outer member moves the load nut axially relative to said one of the inner member and the outer member, the piston assembly comprising:

a helical cylinder which is positioned around said one of the inner member and the outer member to which the load nut is connected, the cylinder comprising first and second cylinder ends, the first cylinder end being connected to said one of the inner member and the outer member to which the load nut is connected; and a helical piston which is slidably received in the cylinder, the piston comprising a first piston end which is oriented toward the first cylinder end and a second piston end which is configured to extend through the second cylinder end and engage the load nut;

wherein with the second inner feature engaged with the second outer feature, the piston assembly is operable to rotate the load nut to thereby move the first inner feature into engagement with the first outer feature to thereby secure the inner member to the outer member.

18. The piston assembly of claim 17, further comprising:

a piston chamber which is formed between the first cylinder end and the first piston end;

wherein the piston chamber is selectively connected to a source of fluid pressure to thereby operate the piston assembly.

19. A method for securing an inner member to an outer member which surrounds at least a portion of the inner member, the inner member comprising first and second axially spaced inner features and the outer member comprising first and second axially spaced outer features which are configured to engage the first and second inner features, respectively, to secure the inner member to the outer member, one of the first inner feature and the first outer feature being formed on a load nut which is threadedly connected to one of the inner member and the outer member such that rotation of the load nut relative to said one of the inner member and the outer member moves the load nut axially relative to said one of the inner member and the outer member, the method comprising:

providing a piston assembly which comprises:

a helical cylinder which is positioned around said one of the inner member and the outer member to which the load nut is connected, the cylinder comprising first and second cylinder ends, the first cylinder end being connected to said one of the inner member and the outer member to which the load nut is connected; and a helical piston which is slidably received in the cylinder, the piston comprising a first piston end which is oriented toward the first cylinder end and a second piston end which is configured to extend through the second cylinder end and engage the load nut;

inserting the inner member into the outer member until the second inner feature engages the second outer feature; and operating the piston assembly to rotate the load nut to thereby move the first inner feature into engagement with the first outer feature to thereby secure the inner member to the outer member.

20. The method of claim 19, further comprising:

prior to the step of operating the piston assembly to rotate the load nut to thereby move the first inner feature into engagement with the first outer feature, applying a preload force on the inner member in a direction opposite to a direction in which the inner member is inserted into the outer member.

* * * * *